US005901769A

United States Patent [19]

Farley

[11] Patent Number: 5,901,769

[45] Date of Patent: May 11, 1999

[54] INFLATABLE PARTITION

[76] Inventor: Brent L. Farley, 1808 Rambling Ridge La., Baltimore, Md. 21209

[21] Appl. No.: 09/026,666

[22] Filed: Feb. 20, 1998

Related U.S. Application Data

[63] Continuation-in-part of application No. 08/742,644, Nov. 1, 1996, abandoned, which is a continuation of application No. 08/451,666, May 26, 1995, abandoned.

[51] Int. Cl.[6] ..... A47H 1/00

[52] U.S. Cl. ..... 160/123; 160/237; 160/DIG. 6

[58] Field of Search ..... 160/330, DIG. 6, 160/237, 123, 124, 135, 184, 332; 52/2.11, 2.17, 2.19, 2.22, 2.23, 2.14; 4/599, 600, 607, 608, 614, 499, 557, 558, 588

[56] References Cited

U.S. PATENT DOCUMENTS

| | | | |
|---|---|---|---|
| 2,028,060 | 1/1936 | Gilbert | 52/2.22 X |
| 2,317,074 | 4/1943 | Mida | 160/124 |
| 2,659,110 | 11/1953 | Carroll | 52/2.22 X |
| 3,629,875 | 12/1971 | Dow et al. | 52/2.22 X |
| 3,918,512 | 11/1975 | Kuneman | 160/90 |
| 4,040,210 | 8/1977 | Land | 160/90 X |
| 4,065,889 | 1/1978 | Fraioli | 52/2.22 |
| 4,156,330 | 5/1979 | Fraioli | 52/2.22 |
| 4,255,907 | 3/1981 | Lightell | 160/90 X |
| 5,311,620 | 5/1994 | Ratje | 4/599 |
| 5,586,594 | 12/1996 | Shapoff | 160/135 |
| 5,678,357 | 10/1997 | Rudio et al. | 52/2.22 X |

*Primary Examiner*—David M. Purol
*Attorney, Agent, or Firm*—Richard L Haff

[57] ABSTRACT

An inflatable partition incorporating a three-dimensional inflatable component. The three-dimensional inflatable component may be attached to a sheet which has attachment apertures along its top edge for receiving a plurality of fasteners. Thus, the combination of inflatable component and sheet may be suspended from a support rod. Alternatively, the three-dimensional component may have a sealed border or other structure configured to enable the fasteners to attach directly to the inflatable component. Thus, the inflatable component, alone, may be suspended from a support rod. A plurality of retention devices for holding useful articles may be incorporated on at least one surface of the partition. The partition may incorporate attractive three-dimensional figures. The partition demonstrates increased stiffness when used as a shower curtain. The partition demonstrates an increased sound-deadening/weight ratio, increasing its usefulness as a shower curtain or room partition.

14 Claims, 7 Drawing Sheets

INFLATABLE PARTITION

CROSS-REFERENCE TO RELATED APPLICATIONS

This application is a continuation-in-part of my application, Ser. No. 08/742,644, filed Nov. 1, 1996, now abandoned, which is a continuation of my application, Ser. No. 08/451,666, filed May 26, 1995, now abandoned.

BACKGROUND OF THE INVENTION

1. Field of the Invention

This invention relates to inflatable partitions, such as room dividers or shower curtains.

2. Description of the Related Art

The prior art is aware of room dividers and shower curtains.

Room dividers may be suspended from tracks in ceilings. Conventional room dividers may be collapsed when an open area is desired and extended to close off a predetermined area. For rooms with high ceilings, conventional room dividers place a great deal of weight on the tracks. When the room dividers are in the collapsed condition, there is even more weight per given track space on the portion of the track suspending the entire partition. This may necessitate repair or replacement of the tracks. Also, the conventional room dividers are more effective in eliminating sight distractions between adjoining rooms than in eliminating sound distractions. The sound-deadening/weight ratio of such room dividers is very low. Thus there is a need for a room divider which will eliminate both sight and sound distractions between adjoining rooms while not imposing undue stress on the tracks. The sound-deadening/weight ratio of such a room divider must be high.

Conventional shower curtains are suspended from support rods by a plurality of fasteners. Usually these fasteners fit around the support rods and through apertures along the top edge of the curtains. Conventional shower curtains are made of light-weight materials such as plastic and are very flexible. As a result, the air currents created by flowing shower water may dislodge the curtains from their desired position and allow water to escape from the shower enclosure. For purposes of this description, shower enclosure is intended to include those areas which contain a shower head and a floor containing a drain and those areas which include a shower head and a bath tub. Some shower curtains are known which contain suction cups which are located between the shower curtain and the bath tub or shower stall. The disadvantages of these conventional suction cups are pointed out in U.S. Pat. No. 2,840,160 to Tischenor. Improved suction cups are disclosed by this patent which are designed to overcome some of the disadvantages of the prior art suction cups. The suction cups of Tischenor have disadvantages in that they require the user to reach down to the lower edge of the shower curtain, whether it be in a tub or stall. This is an undue hardship on individuals with certain physical handicaps. Further, suction cups are for use with thin, flexible curtains, and the resulting curtain does not deaden sound. Thus, those singing in the shower can still create an annoying distraction to others in the area.

Inflatable walls are known. Thus, U.S. Pat. No. 2,830,606 to Daugherty teaches inflatable tents. U.S. Pat. No. 3,629,875 to Dow discloses self-supporting shower enclosures with or without partitions. Both of these patents are directed to self-supporting structures to be used by campers and the like and are not concerned with lightweight, suspended curtains to be used to divide large rooms or lightweight shower curtains to be suspended from support rods. Being intended for use in the outdoors, neither of these structures is concerned with the possibility of having decorative three-dimensional designs as part of the structure or permanent tracks supporting the partition.

SUMMARY OF THE INVENTION

The present invention is directed to three-dimensional, lightweight partitions which may be shower curtains and room dividers.

The shower curtain of this invention overcomes the disadvantages of the prior art curtains. The curtain of the present invention is readily usable by handicapped individuals as it does not require the use of suction cups to prevent the escape of water from the shower enclosure. It deadens sound and thus prevents an annoyance to others in the area. It provides the possibility of presenting three-dimensional designs, thus enhancing attractiveness to children or others who enjoy individualized motifs. It has the characteristic of being easily stored when not in use.

The room dividers of the present invention display the two desirable properties of being light in weight and having a high sound-deadening/weight ratio. When not in use, the room divider of the invention may fold up into a space much smaller than conventional room dividers.

DESCRIPTION OF THE PREFERRED EMBODIMENTS

Figure 1:
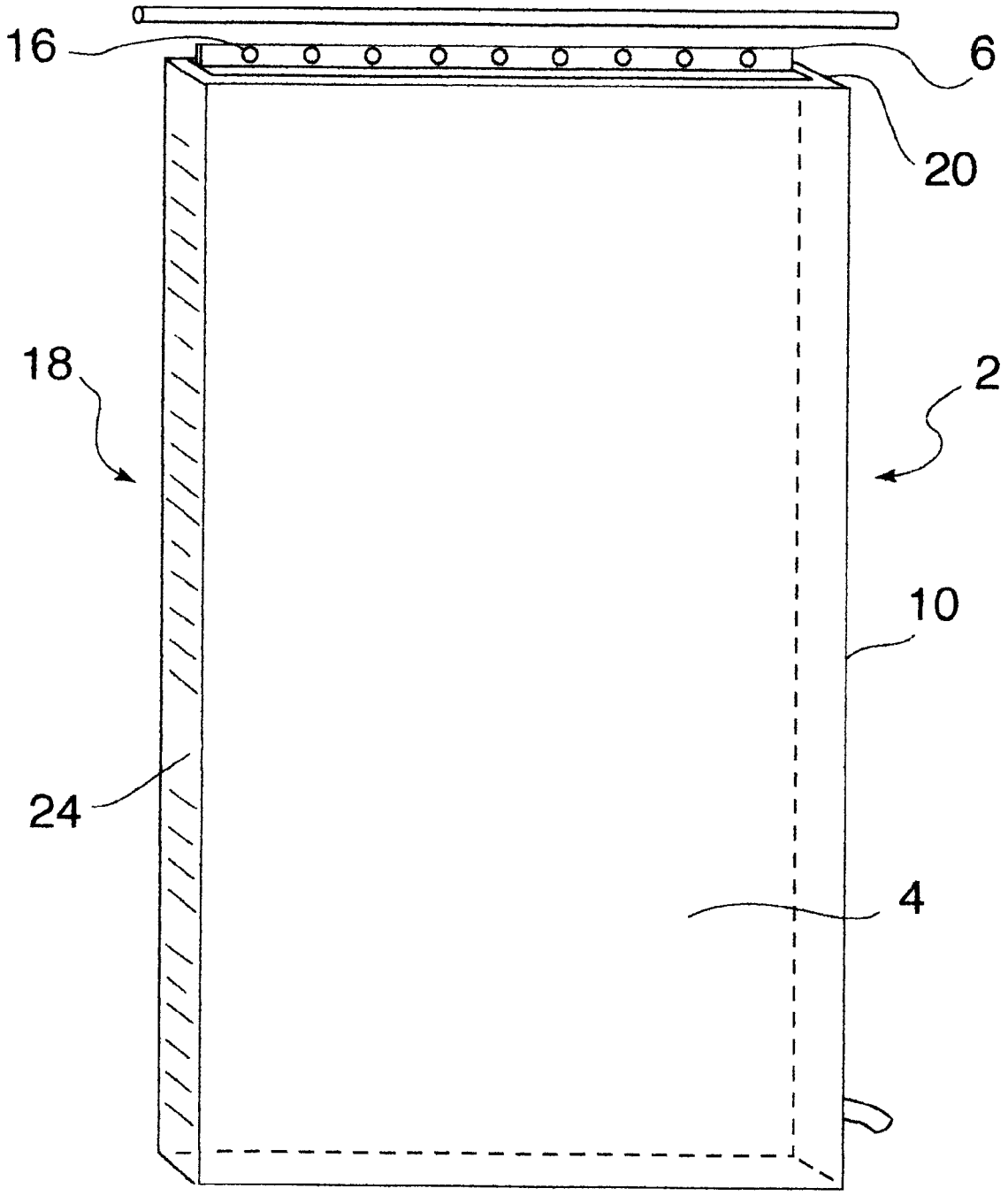
FIG. 1 is an elevational perspective view of a first embodiment of a partition of the present invention.
Figure 2:
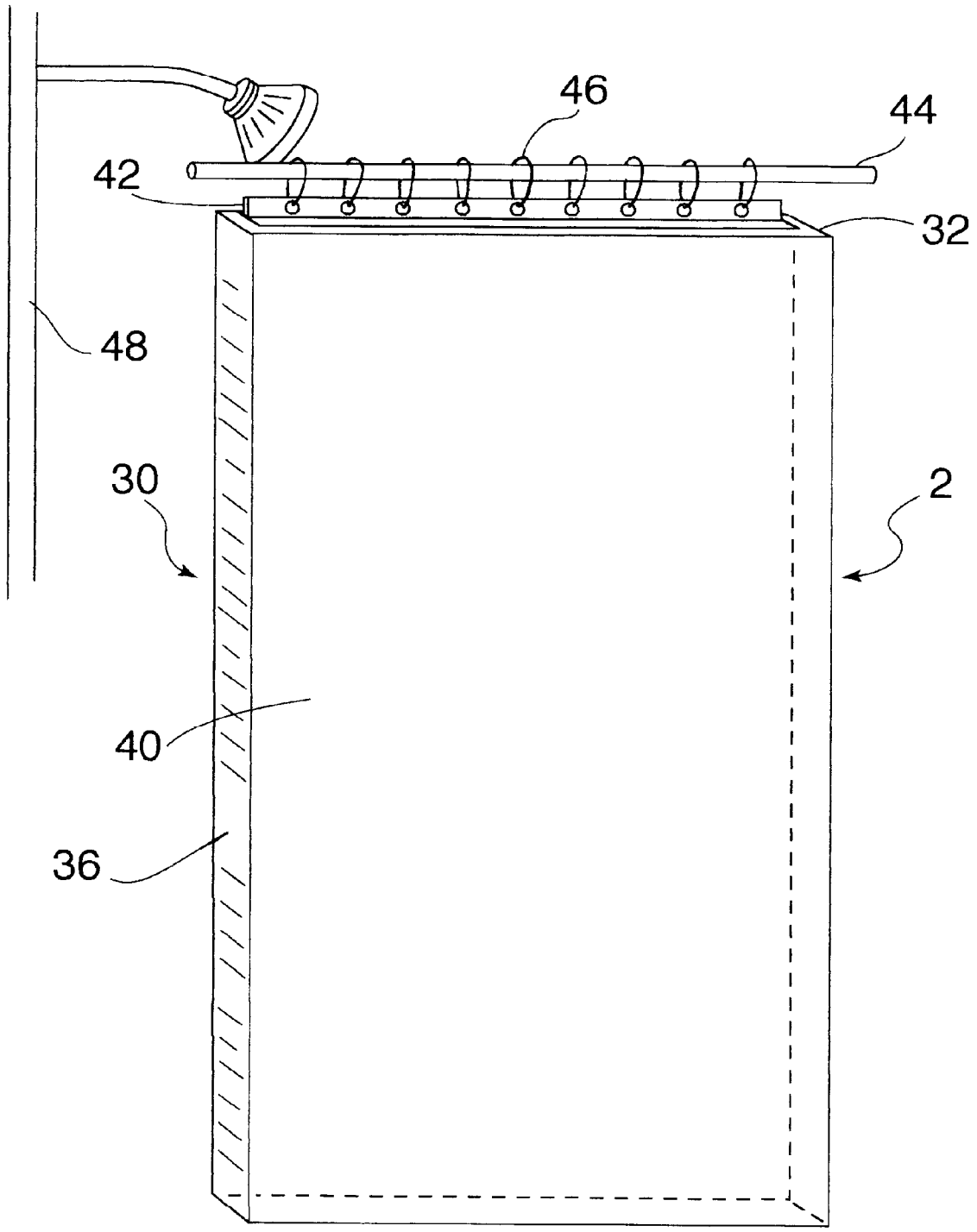
FIG. 2 is an elevational perspective view of a second embodiment of a partition of the present invention.
Figure 3:
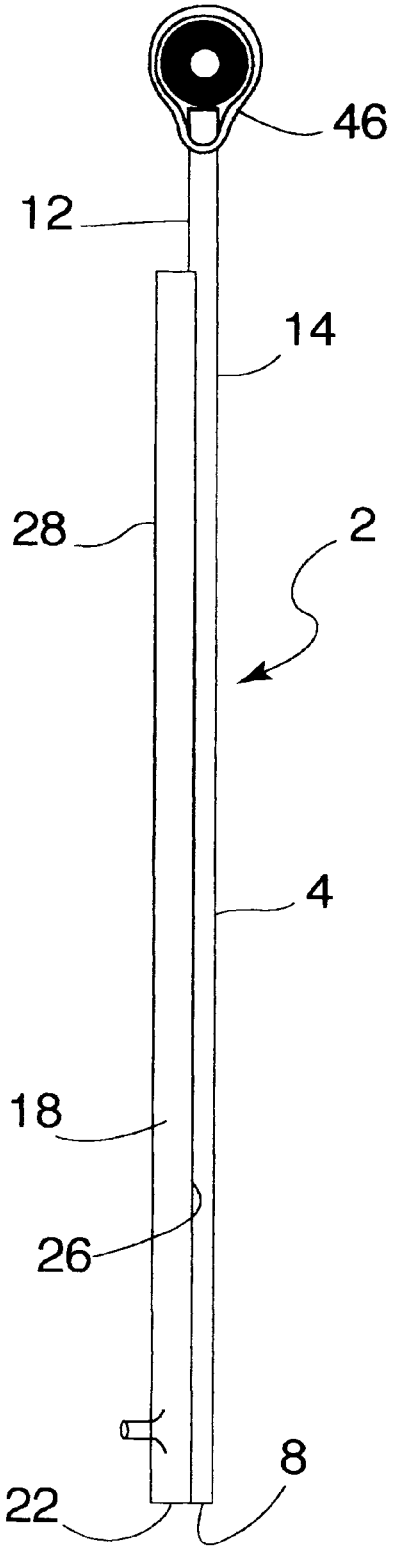
FIG. 3 is a longitudinal cross-sectional view of the partition of the first embodiment of the present invention.
Figure 4:
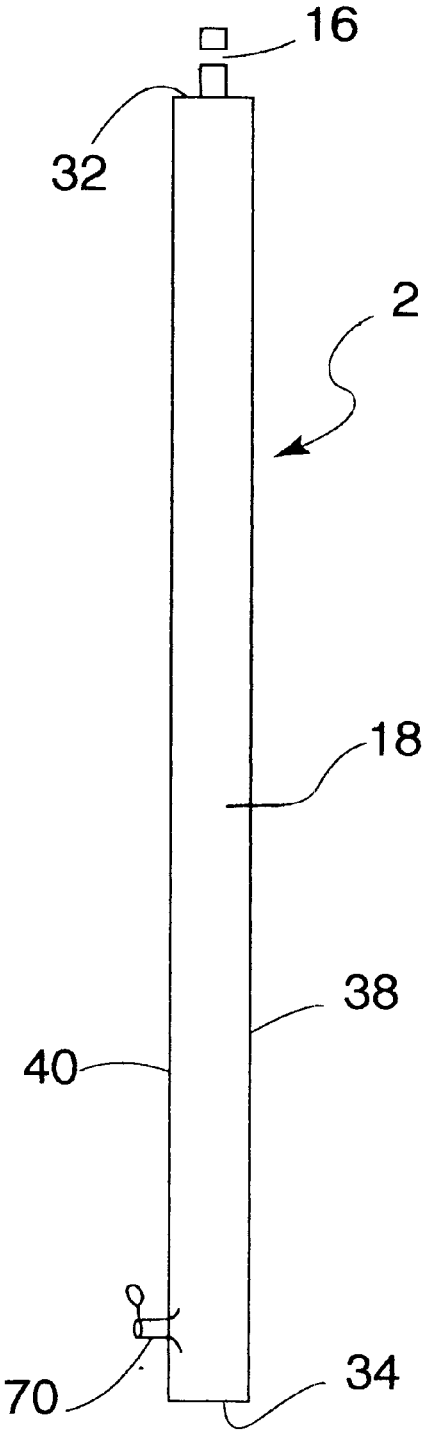
FIG. 4 is a longitudinal cross-sectional view of the partition of the second embodiment of the present invention.
Figure 5:
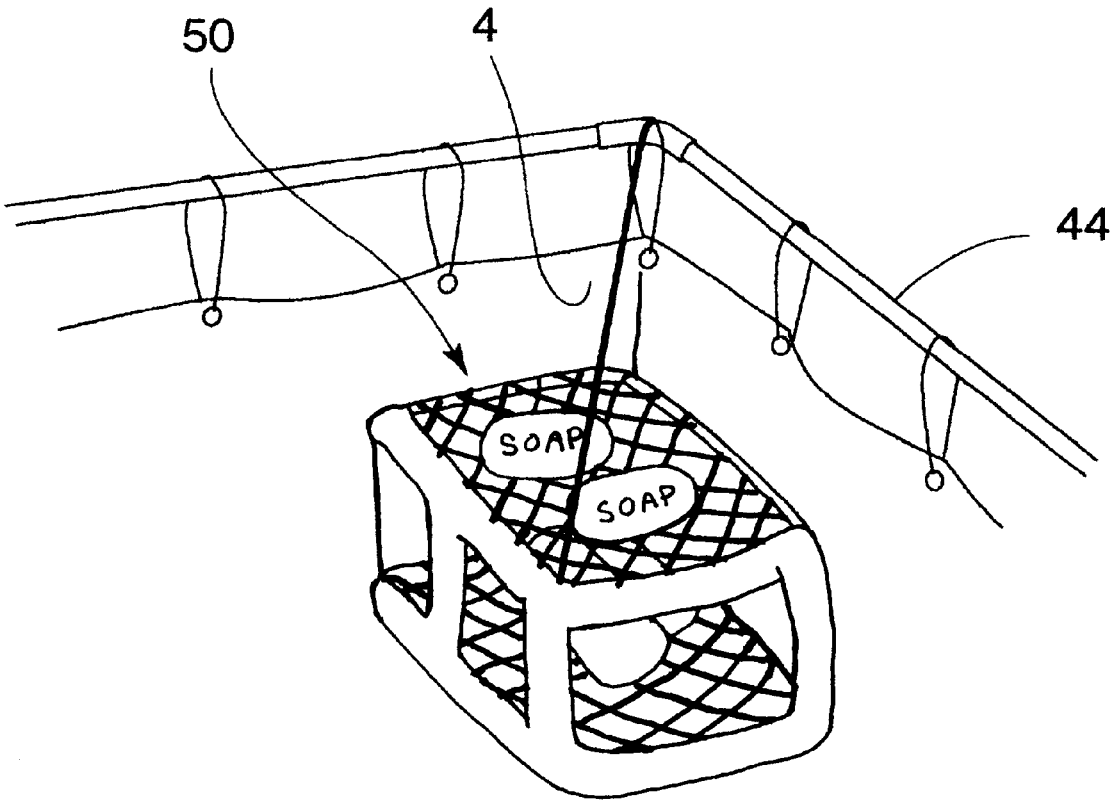
FIG. 5 is an elevational perspective view of a first embodiment of a retention device attached to a partition of the present invention.
Figure 6:
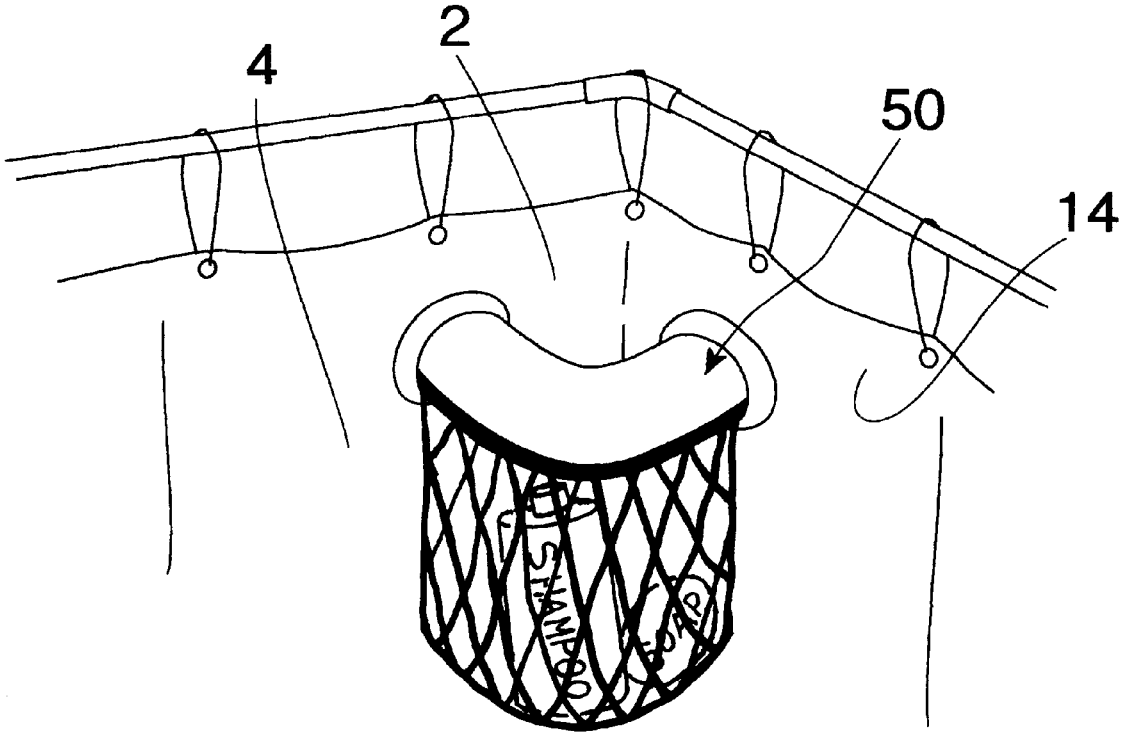
FIG. 6 is an elevational perspective view of a second embodiment of a retention device attached to a partition of the present invention.
Figure 7:
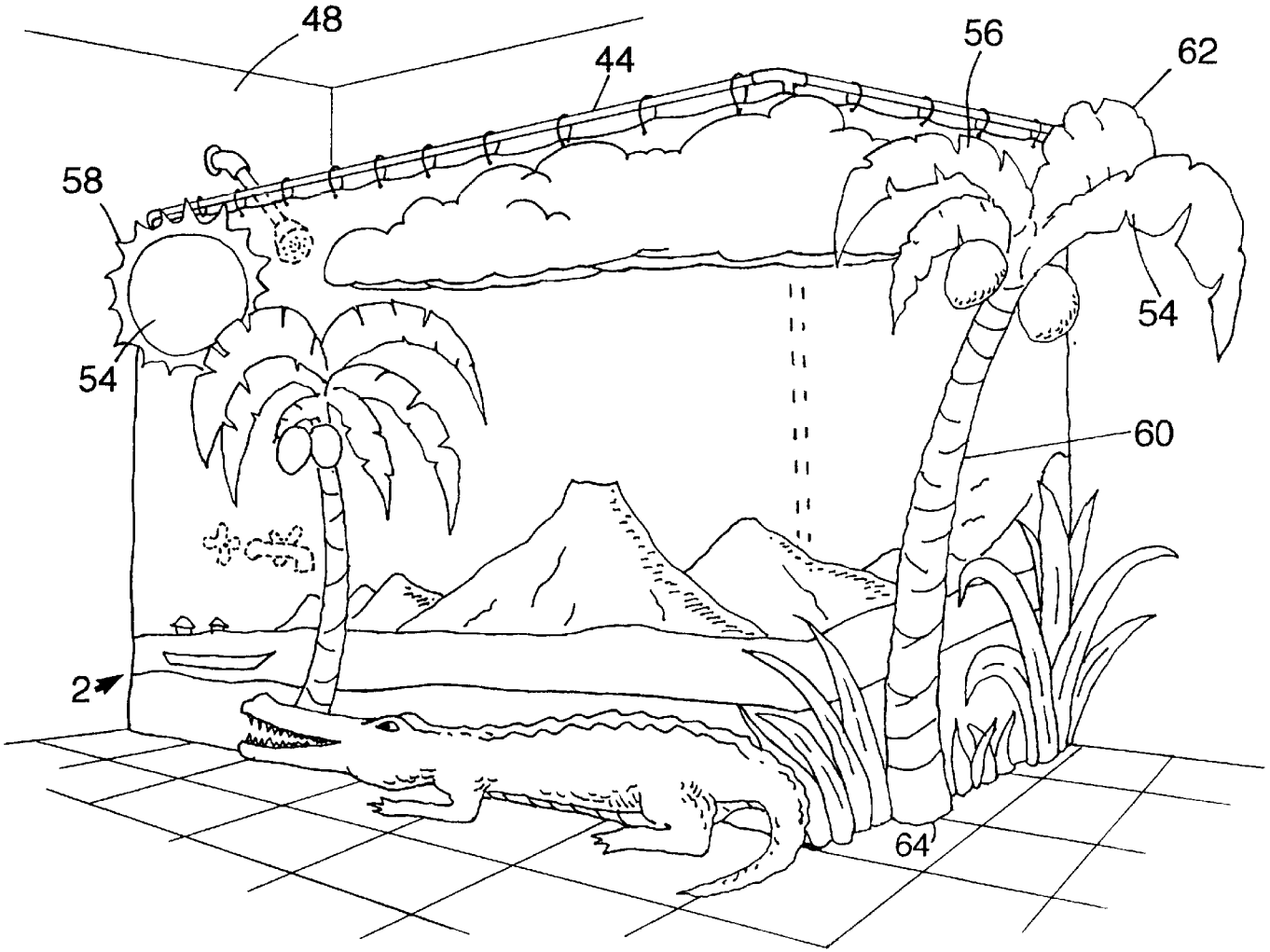
FIG. 7 is an elevational perspective view of a partition of the present invention having a three-dimensional design.
Figure 8:
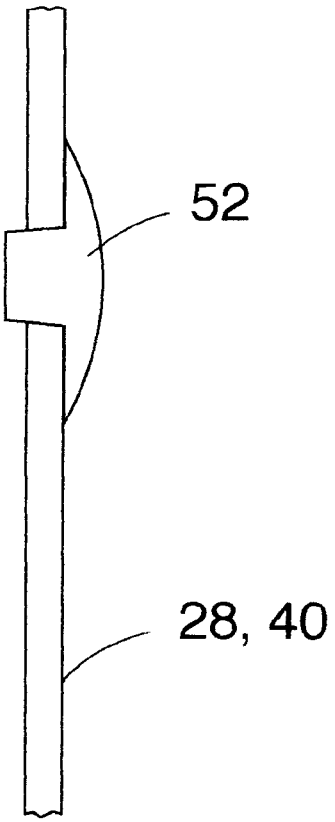
FIG. 8 is a cross-sectional view of a sealable airtight plug in place on a three-dimensional component.
Figure 9:
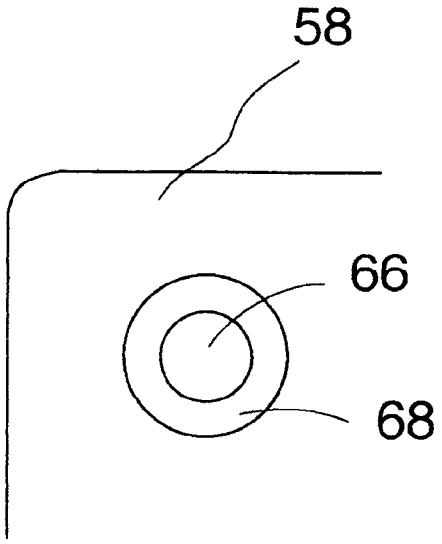
FIG. 9 is an elevational top view of an air opening surrounded by an adhering area in place on a three dimensional design.

The preferred embodiments will now be described with reference to the Figures, like numbers referring to like features throughout.

The partition 2 of the first embodiment of the present invention is made up of a combination of 1) a sheet 4 having a top edge 6, a bottom edge 8, side edges 10, first 12 and second 14 planar surfaces, and a plurality of holding means 16, preferably apertures along the top edge 6 and 2) a three-dimensional inflatable component 18 having a top edge 20, a bottom edge 22, side edges 24, a back surface 26, and a front surface 28.

In manufacture, the sheet 4 has a greater vertical dimension than the inflatable component 18. The sheet 4 and the inflatable component 18 are made separately and the first planar surface 12 of the sheet 4 is permanently attached to the back surface 26 of the three-dimensional inflatable component 18 in any known manner, such as by adhesives. Preferably, both the sheet 4 and the inflatable component 18 are made of plastic for its lightweight, air-tight qualities, but other equivalent materials such as treated cloth are contemplated.

The partition 2 of the second embodiment of this invention is made up of a three-dimensional inflatable component 30 having a top edge 32, a bottom edge 34, side edges 36, a back surface 38, and a front surface 40. On the top edge 32, extending substantially from one side edge 36 to the other, is an elongated planar strip 42 having a plurality of holding means 16. This partition 2 may be manufactured by joining the planar strip 42 to the inflatable component 30 by conventional methods, such as adhesives. Preferably, the strip 42 is the result of the joining together with adhesives of an upper section of the inflatable component 30. The partition 2 is preferably made of lightweight, air-tight plastic, although other suitable materials may be employed.

The holdings means 16 are preferably reinforced apertures so as to bear the weight of the partition 2 without tearing. Sufficient apertures are present so as to enable the weight of the partition 2 to be evenly distributed without placing undue weight on the support rod 44 or any aperture. Alternatively, the support means may be a plurality of hooks which fit into openings extending from, or supported by, the support rod 44.

Either of the two preferred embodiments may be used as a shower curtain or a room divider. The user may enter and exit the enclosed area with ease as the width of each partition is small, offering little resistance to passage, especially if two partitions are moved at their point of meeting. Following passage, the partitions have a natural tendency to resume their original positioning.

The partitions 2 are designed to be hung from a support rod 44 by fasteners 46 in any conventional manner. In a first preferred embodiment, fasteners 46 go around the support rod 44 and through the apertures. In a second preferred embodiment, the support rods 44 are open at the bottom and fasteners 46 extend through this opening to fasten to the partition 2.

The fasteners 46 may be secured in the ceiling of a building, permanently or temporarily attached to the desired walls 48 of a building, or may be held by freestanding frames. Conventional ceiling support rods and fasteners 46 for this purpose are known in the art. Permanent support rods 44 are attached to desired wall 48 by fasteners, such as screws. Temporary support rods 44 are made of a plurality of sections, a first section sliding over a second section, and so on. At least one section contains a spring which tends to extend to force the rod sections into an extended position. This spring pressure holds the support rod 44 in place without affecting the wall 48. Where necessary, conventional support frame are used.

The partitions 2 of the present invention are suitable for use when the support rod 44 is straight. Thus, a room is divided by a substantially straight partition 2 or a shower enclosure is closed on a single side by a partition 2 of this invention. Alternatively, the partitions 2 of this invention are suitable for use when the support rod 44 is curved. Thus, a partition 2 for a circular shower enclosure is within the scope of the present invention. Also, a plurality, e.g., two, straight support rods 44 are joined together with a curved support rod 44. This provides a support system for providing a plurality of partitioned small areas in a large room. Also, this arrangement of support rods 44 makes it possible to enclose two, three, or even four sides of a shower enclosure.

Retention devices 50 may be attached to the partitions 2 of this invention. These devices 50 may be attached where corners are formed or on planar surfaces. When the partition 2 is a shower curtain, the retention devices 50 are useful for holding soap, shampoo, etc. Also, when the partition 2 is a shower curtain, the retention device 50 is preferably an open mesh structure for easy draining. When the partition 2 is a room divider, the retention device 50 may be a solid horizontal shelf for holding knickknacks, books, vases, etc. The retention devices 50 may be suspended from the support rod 44 or held by the partition 2 in any known manner, e.g. adhesives.

An additional feature of the partition 2 of the present invention is the ability of the user to display individualized three-dimensional designs 54. In the first embodiment of this feature, the front surface 28 40 of the three-dimensional component 18 30 is of such a form and color that a three dimensional design 54 will result when the component 18 30 is inflated. Thus, such a design is imparted at the time of manufacture.

In the second embodiment of this feature, the three-dimensional component 18 30 is equipped with sealable airtight plugs 52 which are in a constant position for all manufactured three-dimensional components 18 30. A variety of three-dimensional designs 54 are produced. These three dimensional designs 54 have front 56, back 58, side 60, top 62, and bottom 64 surfaces. The back surfaces 58 of the three-dimensional designs 54 have air openings 66 surrounded by adhering areas 68. For use, the airtight plugs 52 are removed and replaced by the air openings 66 on the back surface 58 of the three-dimensional designs 54. The partition 2 is then inflated through an air valve 70. The three-dimensional designs 54 are held in place by the surrounding adhering areas 68 as well as additional adhering areas as required for structural stability. These additional adhering areas are supplied as layered pieces in which the layers are, in order: peelable covering, adhesive, plastic piece, adhesive, and peelable covering. In use, the peelable coverings are removed and the plastic piece is adhered to the front surface 28 40 of the three-dimensional component 18 30 and to the back surface 58 of the three-dimensional design 54.

In manufacture, the air openings 66 of the three-dimensional designs 54 are located to correspond with the airtight plugs 52 of the three-dimensional components 18 30 so that a multiplicity of air conduits are present for large three-dimensional designs 54. In this way, each three-dimensional component 18 30 is able to support a wide variety of three-dimensional designs 54.

The above description is for illustration purposes, and is not to be understood as limiting the invention which is set forth in the following claims.

I claim:

1. A room divider comprising a plurality of inflatable partitions, each partition consisting essentially of the combination of:

a sheet having a top edge, a bottom edge, side edges, first and second planar surfaces, and a plurality of holding means along the top edge and a three-dimensional inflatable component having a top surface, a bottom surface, side surfaces, a back surface and a front surface, wherein the back surface of the three-dimensional inflatable component is attached to the first planar surface of the sheet, which room divider is suspended from a support rod in a room.

2. The room divider of claim 1, wherein at least one retention device is attached to the second planar surface of the sheet.

3. A shower curtain comprising a plurality of inflatable partitions, each partition consisting essentially of the combination of:

a sheet having a top edge, a bottom edge, side edges, first and second planar surfaces, and a plurality of holding means along the top edge and a three-dimensional inflatable component having a top surface, a bottom surface, side surfaces, a back surface and a front surface, wherein the back surface of the three-dimensional inflatable component is attached to the first planar surface of the sheet, which shower curtain is suspended from a support rod and at least partially encloses a shower enclosure.

4. The shower curtain of claim 3, wherein at least one retention device is attached to the second planar surface of the sheet.

5. The shower curtain of claim 3, wherein an inflatable three-dimensional design is attached to the front surface of the three-dimensional inflatable component.

6. A room divider comprising a plurality of inflatable partitions, each partition consisting essentially of three-dimensional inflatable components, each component having a top surface, a bottom surface, side surfaces, a back surface, and a front surface, and an elongated planar strip having a plurality of holding means above the top surface which extends substantially from one side edge to the other, which room divider is suspended from a support rod in a room.

7. The room divider of claim 6, wherein at least one retention device is attached to the back surface of the three-dimensional inflatable component.

8. The room divider of claim 6, wherein the elongated planar strip is located along the top surface of the three-dimensional inflatable component essentially midway between the front surface and the back surface.

9. The room divider of claim 6, wherein the elongated planar strip is located along the top surface at the back surface of the three-dimensional inflatable component.

10. A shower curtain comprising a plurality of inflatable partitions, each partition consisting essentially of three-dimensional inflatable components, each component having a top surface, a bottom surface, side surfaces, a back surface, and a front surface, and an elongated planar strip having a plurality of holding means above the top surface which extends substantially from one side edge to the other, which shower curtain is suspended from a support rod and at least partially encloses a shower enclosure.

11. The shower curtain of claim 10, wherein at least one retention device is attached to the back surface of the three-dimensional inflatable component.

12. The shower curtain of claim 10, wherein an inflatable three-dimensional design is attached to the front surface of the three-dimensional inflatable component.

13. The shower curtain of claim 10 wherein the elongated planar strip is located along the top surface of the three-dimensional inflatable component essentially midway between the front surface and the back surface.

14. The shower curtain of claim 10, wherein the elongated planar strip is located along the top surface at the back surface of the three-dimensional inflatable component.

* * * * *